US007281938B1

(12) United States Patent
Wu

(10) Patent No.: US 7,281,938 B1
(45) Date of Patent: Oct. 16, 2007

(54) SMALL SIZE ELECTRICAL CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/491,670

(22) Filed: Jul. 24, 2006

Related U.S. Application Data

(63) Continuation-in-part of application No. 11/201,521, filed on Aug. 11, 2005, now Pat. No. 7,114,980.

(51) Int. Cl.
*H01R 13/627* (2006.01)

(52) U.S. Cl. ..... 439/353

(58) Field of Classification Search ..... 439/350–358
See application file for complete search history.

(56) References Cited

U.S. PATENT DOCUMENTS

| | | | | |
|---|---|---|---|---|
| 5,564,939 | A * | 10/1996 | Maitani et al. | 439/352 |
| 6,095,862 | A | 8/2000 | Doye et al. | |
| 6,454,577 | B1 * | 9/2002 | Yi | 439/108 |
| 6,589,066 | B1 * | 7/2003 | Wu | 439/352 |
| 6,592,391 | B1 * | 7/2003 | Wu | 439/352 |
| 6,641,425 | B1 * | 11/2003 | Wu | 439/352 |
| 6,648,665 | B1 * | 11/2003 | Wu | 439/352 |
| 6,648,666 | B1 * | 11/2003 | Wu | 439/352 |
| 6,659,790 | B1 * | 12/2003 | Wu | 439/352 |
| 6,702,602 | B2 * | 3/2004 | Wu | 439/352 |
| 6,702,603 | B2 * | 3/2004 | Wu | 439/352 |
| 6,887,091 | B1 * | 5/2005 | Wu | 439/352 |
| 7,114,980 | B1 * | 10/2006 | Wu | 439/352 |
| 7,134,914 | B1 * | 11/2006 | Wu | 439/610 |
| 7,147,501 | B1 * | 12/2006 | Wu | 439/352 |
| 7,147,502 | B1 * | 12/2006 | Wu | 439/352 |
| 7,160,135 | B1 * | 1/2007 | Wu | 439/352 |
| 7,207,823 | B1 * | 4/2007 | Yang | 439/352 |
| 2003/0236017 | A1 * | 12/2003 | Waddell et al. | 439/352 |
| 2004/0023544 | A1 * | 2/2004 | Wu | 439/352 |
| 2004/0023545 | A1 * | 2/2004 | Wu | 439/352 |
| 2004/0023546 | A1 * | 2/2004 | Wu | 439/352 |
| 2006/0009080 | A1 | 1/2006 | Regnier et al. | |
| 2006/0014438 | A1 | 1/2006 | Regnier | |
| 2006/0019525 | A1 * | 1/2006 | Lloyd et al. | 439/352 |
| 2006/0040556 | A1 * | 2/2006 | Neer et al. | 439/607 |
| 2006/0134961 | A1 * | 6/2006 | Regnier et al. | 439/331 |
| 2006/0134985 | A1 * | 6/2006 | Reed et al. | 439/607 |
| 2006/0189197 | A1 * | 8/2006 | Reed et al. | 439/352 |

* cited by examiner

*Primary Examiner*—Ross Gushi
(74) *Attorney, Agent, or Firm*—Wei Te Chung

(57) ABSTRACT

An electrical connector assembly (200) includes a plug connector (100) and a board connector (300). The board connector defines a frame (80) having a pair of holes (809) for receiving a pair of latches (3112) of a latch member (31) the plug connector, a hollow interior cavity (806) receiving part of housing (1) of the plug connector, and an insulative housing (90) supported a number of terminals (91) electrically connecting with conductive pads (21) of a circuit card (2) of the plug connector (100). The plug connector (100) includes a pulling member (32) cooperating with the latch member to actuate the latches of the latch member from separating from the holes of the board connector to disengage the board connector from the plug connector.

20 Claims, 12 Drawing Sheets

SMALL SIZE ELECTRICAL CONNECTOR ASSEMBLY

CROSS-REFERENCE TO RELATED APPLICATIONS

This application is related to U.S. patent application Ser. No. 11/201,521 filed on Aug. 11, 2005 and entitled "CABLE CONNECTOR ASSEMBLY WITH LATCHING MECHANISM", U.S. patent application Ser. No. 11/201,461 filed on Aug. 11, 2005 and entitled "CABLE CONNECTOR ASSEMBLY WITH LATCHING MECHANISM", U.S. patent application Ser. No. 11/268,906 filed on Nov. 8, 2005 and entitled "CABLE CONNECTOR ASSEMBLY WITH LATCHING MECHANISM", U.S. patent application Ser. No. 11/268,902 filed on Nov. 8, 2005 and entitled "JUXTAPOSED CABLE CONNECTOR ASSEMBLIES", and U.S. patent application Ser. No. 11/322,692 filed on Dec. 30, 2005 and entitled "STACKED CONNECTOR ASSEMBLY", U.S. patent application Ser. No. 11/213,048 filed on Aug. 26, 2005 and entitled "CABLE CONNECTOR ASSEMBLY WITH EMI GASKET", and the copending U.S. patent application entitled "CABLE CONNECTOR ASSEMBLY WITH LATCHING MECHANISM", all of which have the same applicant and assignee as the present invention. The disclosure of these related applications is incorporated herein by reference. The present invention is a CIP (continuation-in-part) of U.S. patent application Ser. No. 11/201,521 filed on Aug. 11, 2005 now U.S. Pat. No. 7,114,980.

BACKGROUND OF THE INVENTION

1. Field of the Invention

The present invention generally relates to an electrical connector assembly, and more particularly to an electrical connector assembly with small size used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a cable connector assembly connecting with the small-size drive and a header mounted on the printed circuit board. The cable connector assembly defined in the specification comprises a pair of engagable metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and a pulling member cooperating with the latch member for actuating the latch member to separate from the header. The latch member is assembled to a rear portion of a base of the upper housing with latch portion exposed beyond a front portion of the base of the upper housing to locate above a tongue portion of the upper housing. However, such elongated latch member is hard to be actuated by the pulling member, otherwise the latch member must have enough thickness or made by high-quality material having enough rigidity to achieve the goal of latching reliably and unlatching easily.

High speed data transfer systems require electrical connectors in which the electrical impedance can be controlled in order to maintain the required data transfer rate of the electrical system. Low profile connectors, such as those used in SFP (Small Form Factor Pluggable) applications are desired in electronic devices in which space is at a premium and thus it is difficult to guide the opposing mating plug connectors into contact with such connectors. The plug connector typically includes a circuit card that has a projecting edge that is received within a card opening in the SFP connector. Shielding cages are typically utilized with such connectors to control the emission of electromagnetic interference. These cages often serve as a secondary housing for the connector in that they substantially enclose the connectors. The small size of the SFP style connectors makes it difficult for ensuring that the opposing mating connectors mate properly with the SFP connectors, especially in a blind mating application.

Hence, an improved electrical connector assembly is provided in the present invention to address the problems mentioned above and meet the current trend.

BRIEF SUMMARY OF THE INVENTION

Accordingly, an object of the present invention is to provide an electrical connector assembly which form reliable electrical connection therebetween and disengage from each other easily.

Another object of the present invention is to provide an electrical connector assembly with keyed structures for properly guiding a plug connector to a board connector.

In order to achieve the above-mentioned object, an electrical connector assembly, comprises a plug connector and board connector for mounted on a planar circuit board. The plug connector comprises a housing, a plurality of conductive contacts located in the housing, at least one cable electrically connecting with the conductive contacts, a pulling member moveable relative to the housing in a horizontal direction, and a latch member discrete from the pulling member and assembled to the housing. The latch member comprises an engaging portion assembled to the metal housing, a rear actuation section extending from the engaging portion and actuated by a cooperating portion of the pulling member, and a front latch portion extending forwardly from at least one of the engaging portion and the actuation section. The board connector comprises an outer shield housing defining at least one hole in a rear portion thereof to receive the latch portion of the latch member of the plug connector and an interior cavity in a front portion thereof to receive part of the metal housing of the plug connector, an insulative housing located in the front portion of the outer shield housing and received in the interior cavity, and a plurality of terminals supported by the insulative housing to electrically connect with the conductive contacts of the plug connector. The pulling member is capable of actuating the latch portion of the latch member to separate from the hole of the board connector for disengaging the board connector from the plug connector.

Other objects, advantages and novel features of the invention will become more apparent from the following detailed description of the present embodiment when taken in conjunction with the accompanying drawings.

DETAILED DESCRIPTION OF THE INVENTION

Figure 1:
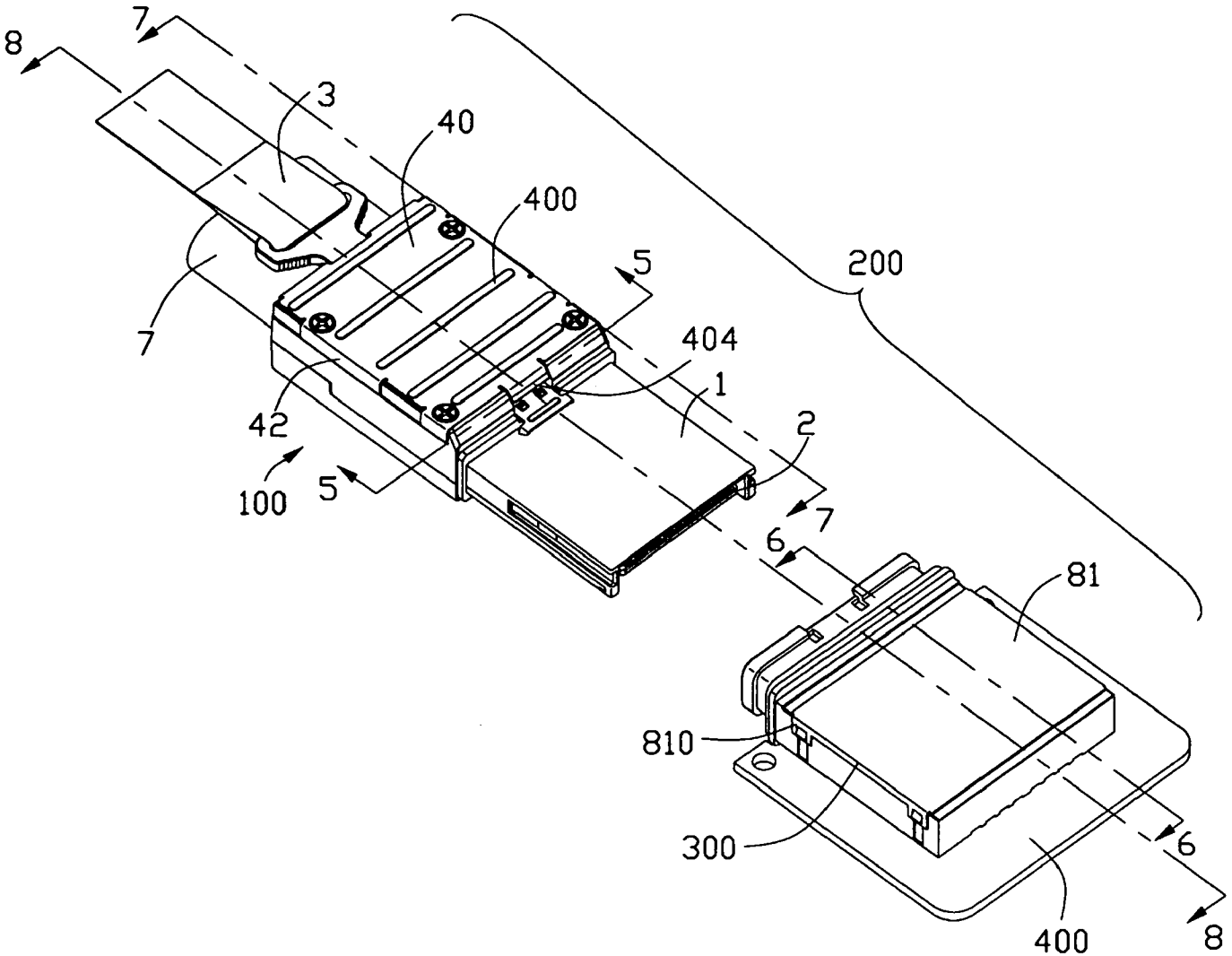
FIG. 1 is a perspective view of an electrical connector assembly of the present invention illustrating the detached state between a plug connector and a board connector.

Reference will now be made to the drawing figures to describe the present invention in detail.

Figure 2:
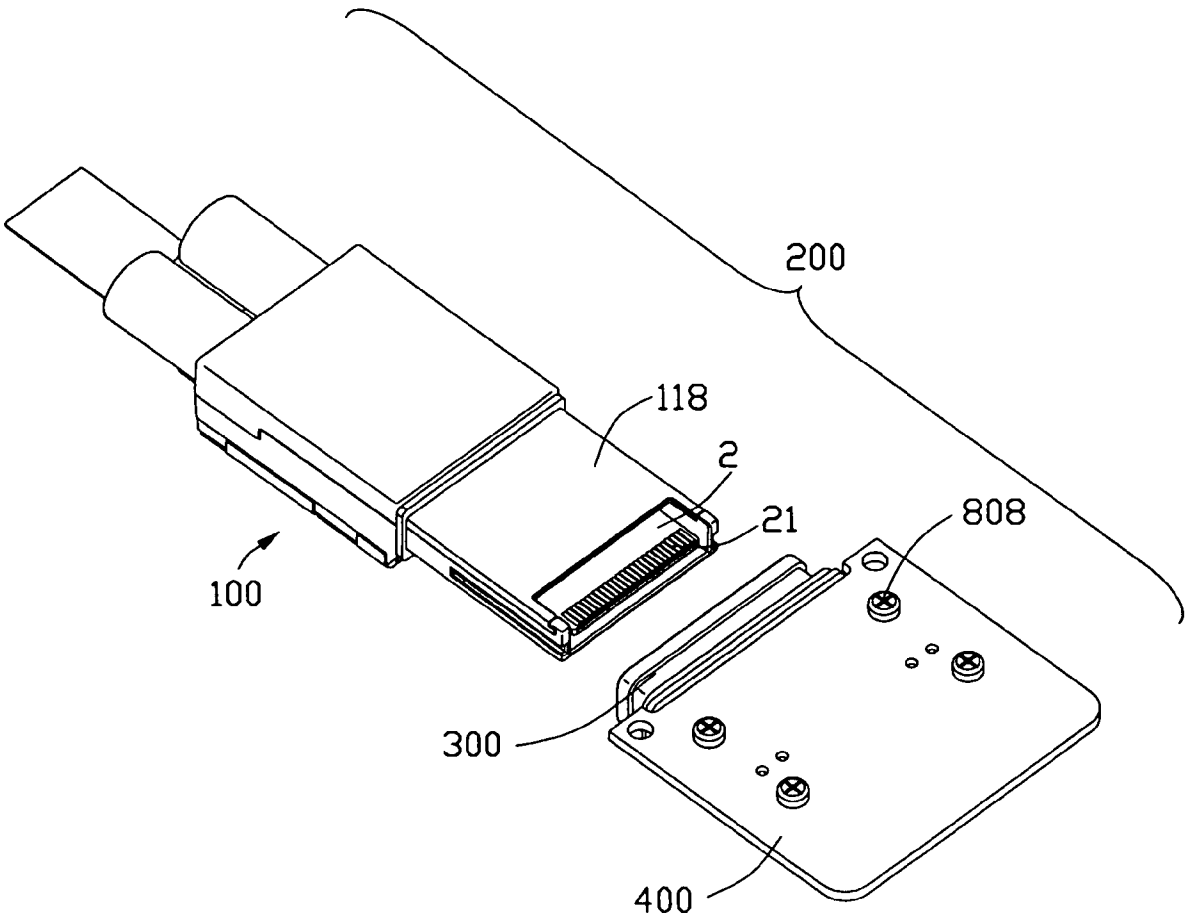
FIG. 2 is a view similar to FIG. 1, but viewed from a different aspect.

Referring to FIGS. 1-2, an electrical connector assembly 200 in accordance with the present invention comprises a plug connector 100 and a board connector 300 mounted on a planar circuit board 400 for mating with the plug connector 100.

Figure 3:
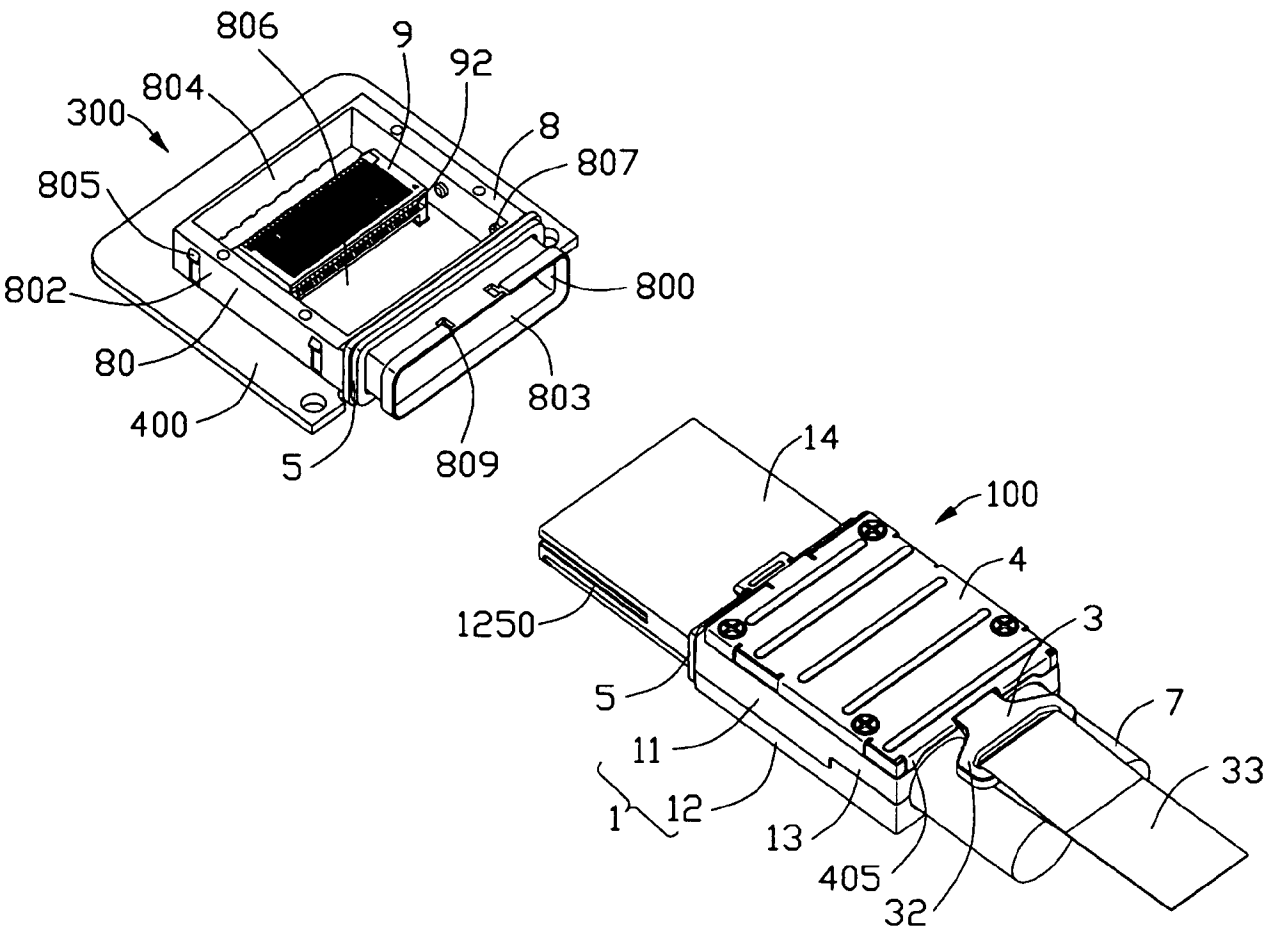
FIG. 3 is a partially exploded, perspective view of the electrical connector assembly in accordance with the present invention with the board connector removed a cover portion.
Figure 4:
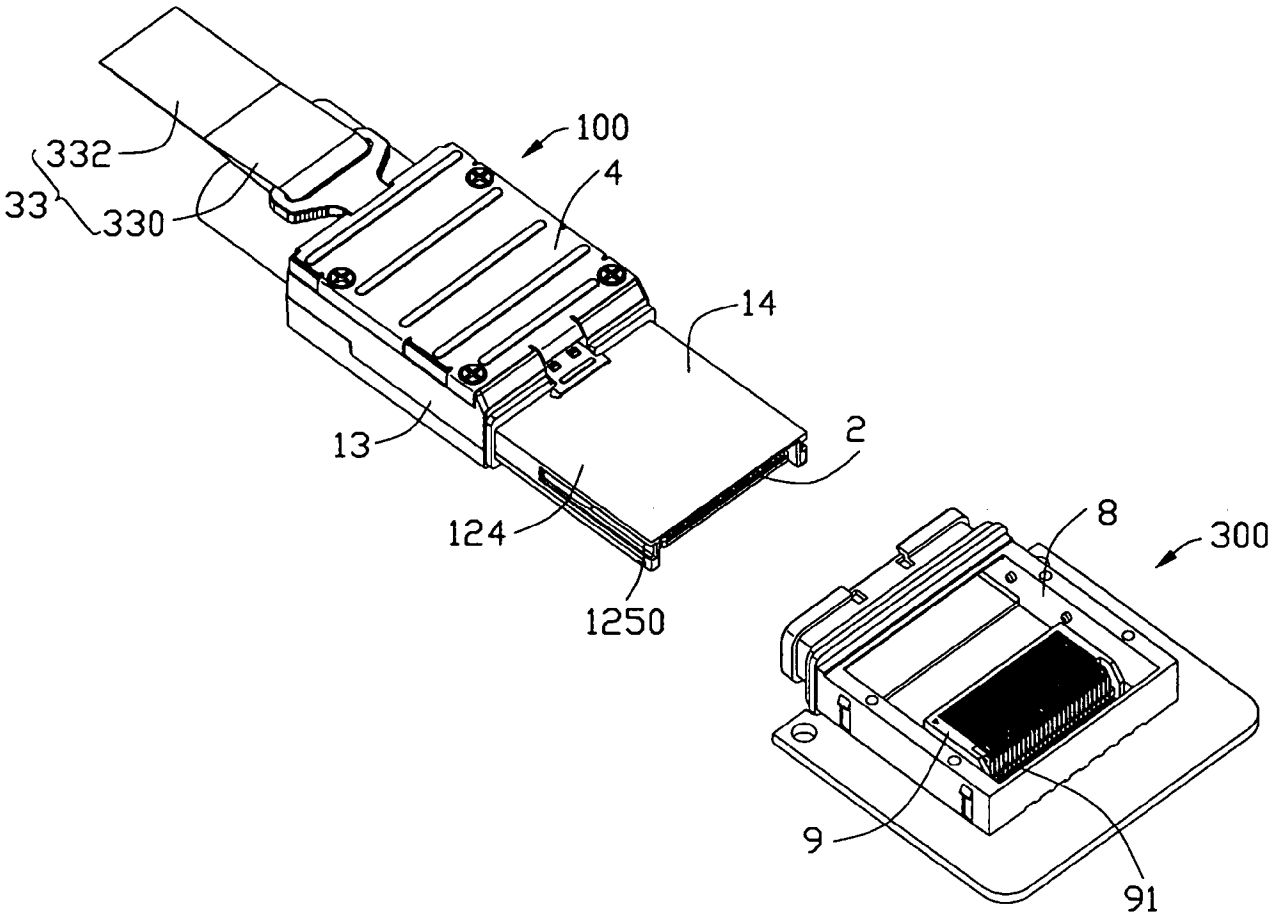
FIG. 4 is a view similar to FIG. 3, but viewed from a different aspect.
Figure 5:
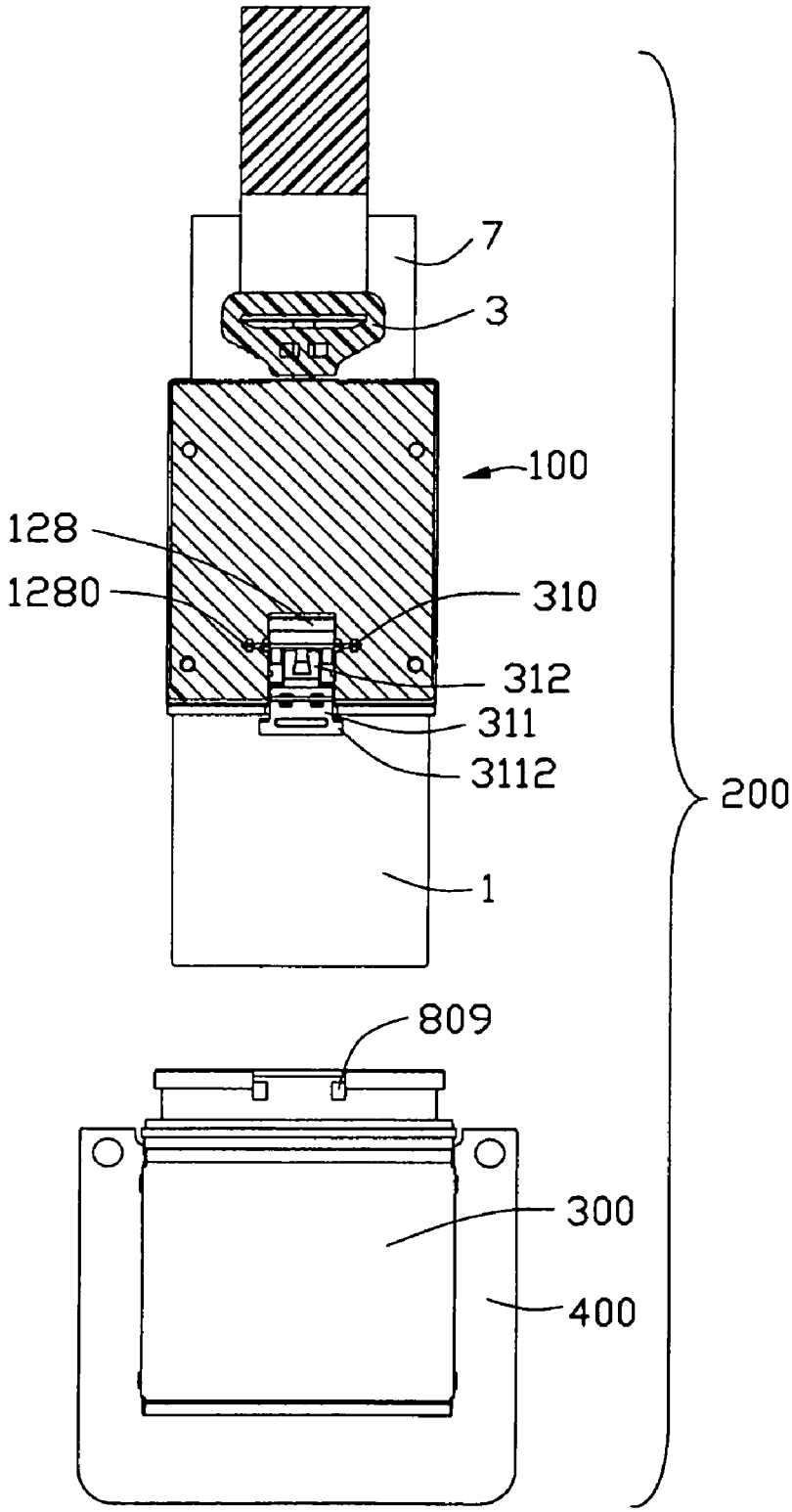
FIGS. 5-8 are cross-section views taken along lines 5-5 to 10-10 of FIG. 1.
Figure 6:
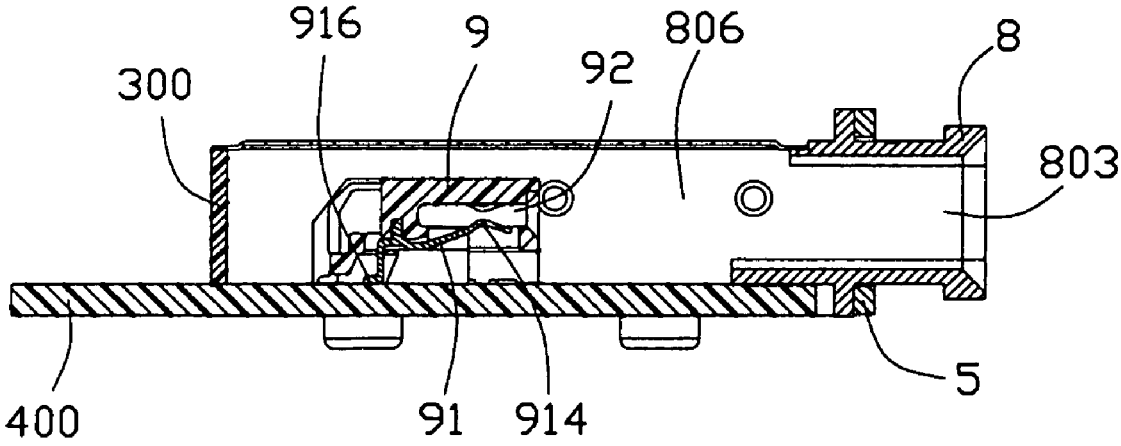
Figure 7:
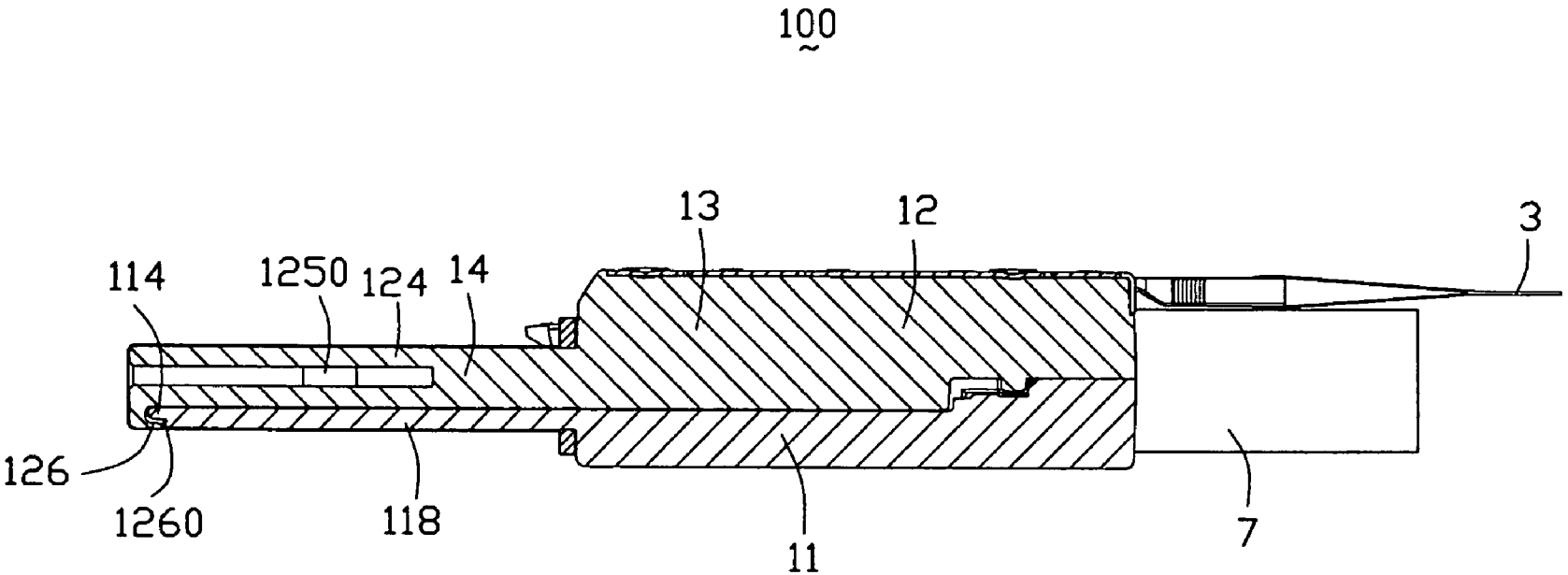
Figure 8:
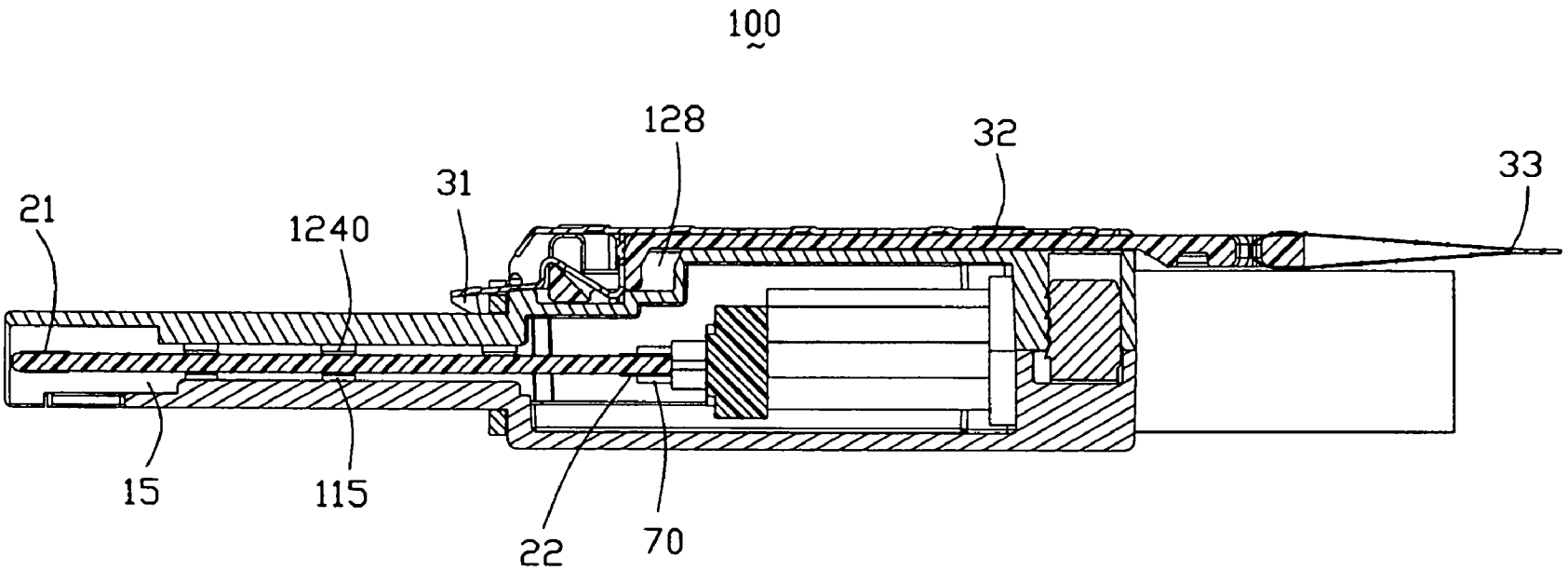

Referring to FIGS. 3-4 in conjunction with FIGS. 5, 7-9, the plug connector 100 comprises a metal housing 1, a circuit card 2 located in the housing 1, a pair of cables 7 juxtaposed arranged to electrically connect with the circuit card 2, a latch mechanism 3 assembled to the housing 1, a metal shell 4 assembled to the housing 1 to partially cover the latch mechanism 3.

The housing 1 of the plug connector 100 is made of metal material and comprises a base 11, a cover 12 engagable with the base 11 and a receiving space 15 formed between the base and the cover 11, 12. Each base 11 and cover 12 comprises a rectangular base section 13 and an elongated tongue section 14 extending forwardly from the base section 13.

The base sections 13 of the base 11 and the cover 12 together define a space to receive rear portion of the circuit card 2 and front portions of the pair of cables 7 electrically connecting with the circuit card 2. The tongue section 14 of the base portion 11 comprises a first panel 118 formed with a pair of ribs (not labeled) located at opposite sides thereof. Each rib forms a tip end 114 extending beyond a front edge of the first panel 118. The first panel 118 also forms two pairs of first standoffs 115 spaced arranged thereon, and each first standoff 115 defines a first positioning hole therein.

The base section 13 of the cover 12 defines a first recess section 127 consisting of different-size first and second recesses (not shown) and a deeper and narrower second recess section 128 formed in a front portion of the base section 13 to communicate with a front surface of the base section 13. A deeper slit 1280 is defined in the front portion of the base section 13 and extends in a direction perpendicular to that of the second recess section 128 to communicate with the second recess section 128.

The tongue section 14 of the cover 12 comprises a second panel 124 and a pair of side walls 125 extending downwardly from opposite sides of the second panel 124. The second panel 124 is longer than the first panel 118. A pair of guiding channels 1250 are defined in corresponding side walls 125 opened toward outside for guiding the proper insertion of the plug connector 100 along desired direction and positioning the plug connector 100 relative to the board connector 300. The guiding channels 1250 are sized different from each other in the side walls 125. A pair of protrusions 126 extend rearward from a front surface of the second tongue section 14 and respectively locate below the side walls 125 to form a pair of gaps 1260 therebetween. The second panel 124 forms three pairs of second standoffs 1240 are symmetrically arranged thereon with two pairs of second standoffs 1240 formed with posts (not shown) extending downwardly.

The circuit card 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the circuit card 2. Two pairs of holes (not shown) are symmetrically arranged on the circuit card 2 corresponding to the position of the first and second standoffs 115, 1240.

The latch mechanism 3 comprises a latch member 31 latching with the board connector 300, a pulling member 32 cooperating with the latch member 31 to actuate the latch member 31 to unlatch from the board connector 300, and an elective pull tape 33 assembled to the pulling member 32.

Figure 9:
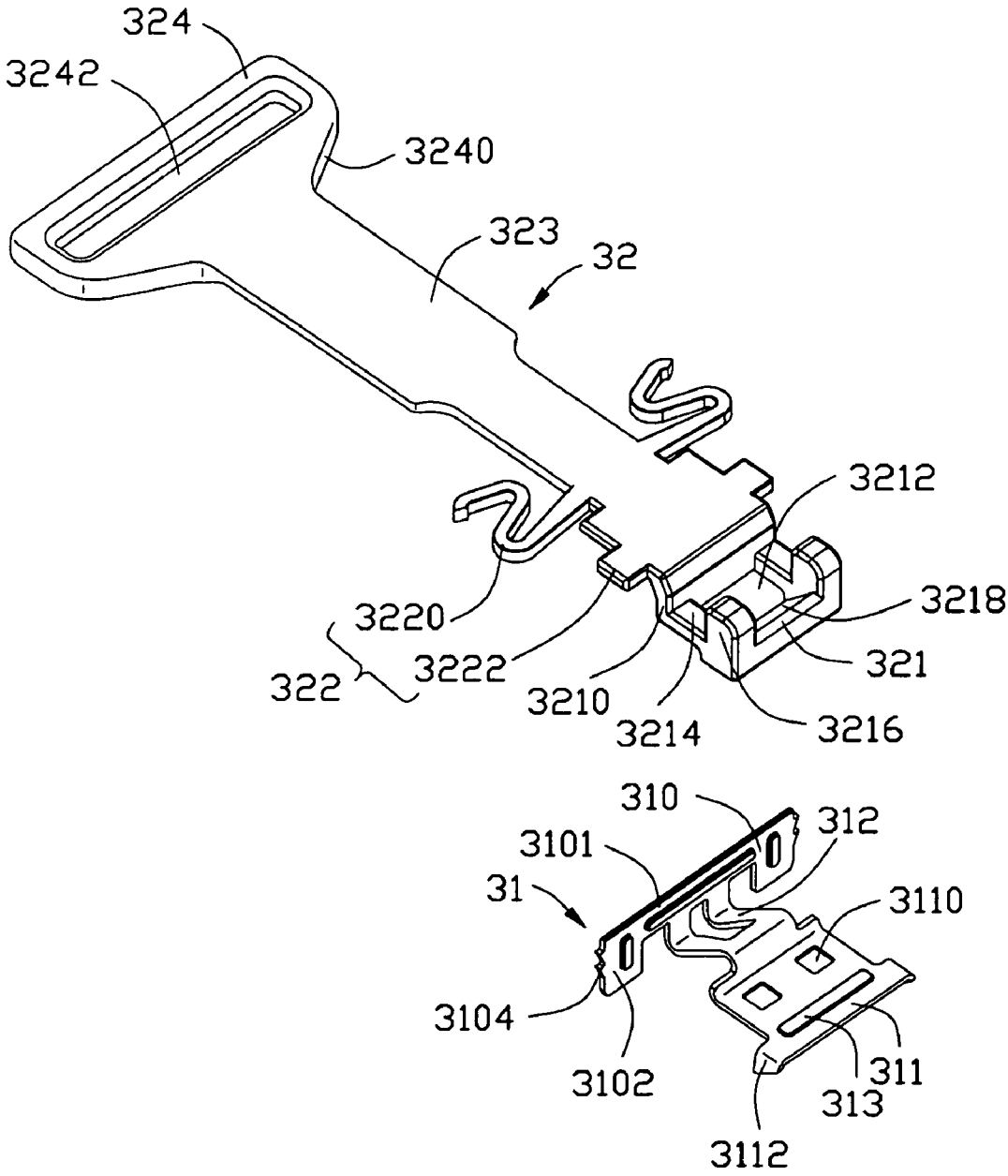
FIG. 9 is a partially exploded view of latch mechanism of the plug connector of the electrical connector assembly.
Figure 10:
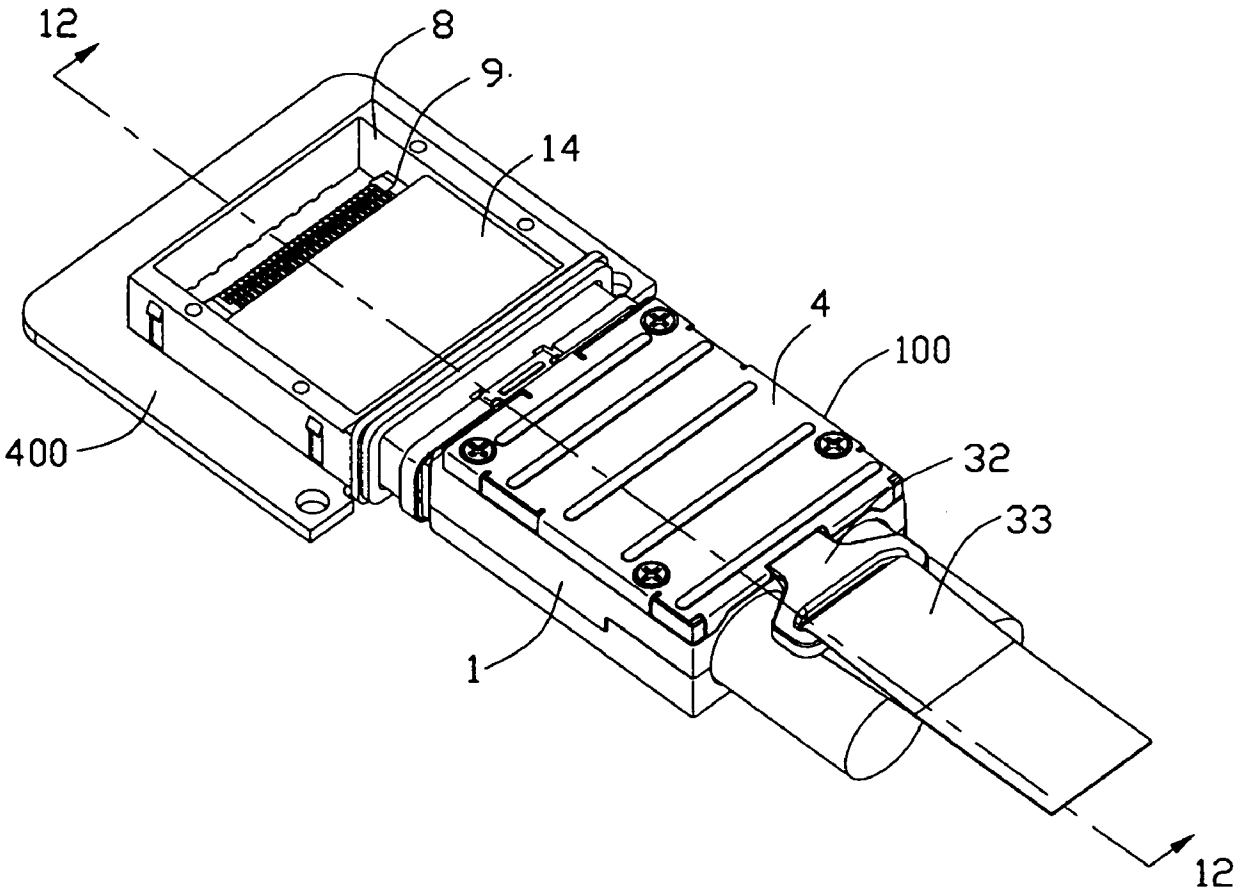
FIGS. 10-11 are assembled views of FIGS. 1-2.
Figure 11:
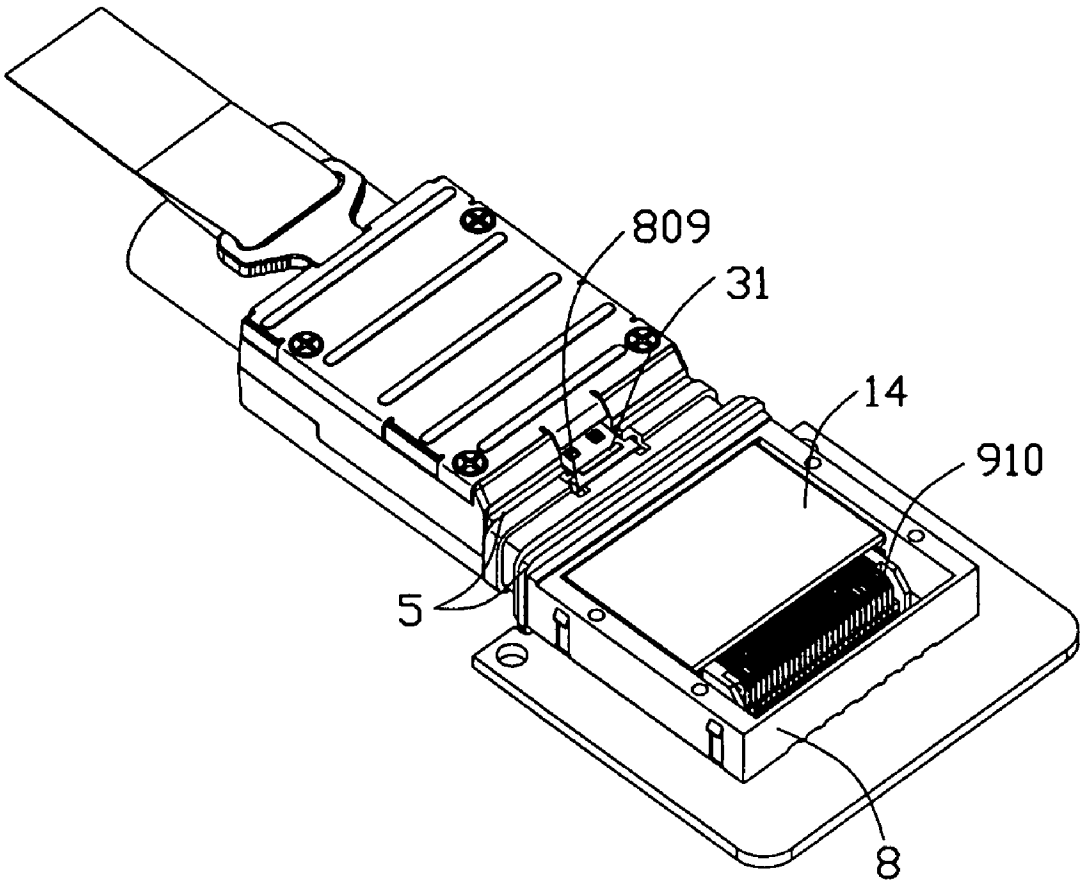

Particularly referring to FIG. 9, the latch member 31 is made of metal material and is a cantilever-type member. The latch member 31 comprises an N-shape engaging portion 310 located in a vertical surface, a flat latching portion 311 located in a horizontal surface perpendicular to the vertical surface and an inclined actuation section 312 connecting the engaging portion 310 with the latching portion 311 to provide spring force to the latch member 31. The engaging portion 310 comprises a transverse bar section 3101 and a pair of side sections 3102 extending downwardly from opposite sides of the bar section 3101. Each side section 3102 is formed with barbs 3104 on outmost edge thereof. The flat latching portion 311 defines a pair of rectangular holes 3110 at a rear portion thereof adjacent to the actuation section 312 and a pair of latches 3112 bending downwardly from opposite sides of the front edge thereof. The actuation section 312 connects with middle portion of the bar section 3101 and extends upwardly from a lower edge of the bar section 3101. The actuation section 312 also defines a hole therein for adjusting spring force of the latch member 31 through changing size and shape of the hole. Each of the side section 3102 and the latching portion 310 is formed with a rib 313 stamped therewith for respectively enhancing the engagement with the housing 1 and the board connector 300.

The pulling member 32 is made by insulative material and comprises a front cooperating portion 321, an elongated intermediate portion 323 extending rearward form the cooperating portion 321 and formed with an interference portion 322, and an operating portion 324 formed at a rear end of the intermediate portion 323. The interference portion 322 comprises a pair of stop sections 3212 formed at opposite sides of the intermediate portion 323 and located adjacent to the cooperating portion 321 and a pair of elastic sections 3210 formed at middle portion of the intermediate portion 323. Each elastic section 3210 comprises a transverse block section 3224 and a V-shape claw section 3226 extending rearward from the block section 3224. The cooperating portion 321 comprises a vertical section 3210 connecting the cooperating portion 321 with the intermediate portion 323 and a body section 3212 extending forwardly from a lower edge of the vertical section 3210. The body section 3212 forms a pair of upwardly extending ribs 3214 with tip end formed with enlarged protrusions 3216. A slanted surface 3218 downwardly and rearward extends from a front surface of the body section 3212. The operating portion 324 is enlarged from the intermediate portion 323 and thus, forms a pair of slanted edges 3240 for facilitating handle. The operating portion 324 also defines a rectangular slot 3242 in a main portion thereof to cooperate with the pull tape 33.

The pull tape 33 is a piece of belt with opposite ends sticked to each other to form a loop portion 330 and a rear pull portion 332. The pull tape 33 firstly protrudes through the slot 3242 of the operating portion 324 of the pulling member 32 and then sticks the opposite ends together.

The conductive shell 4 comprises a body portion 40 formed with a plurality of bars 400 on a top surface for increasing friction and a pair of lateral walls 42 extending downwardly from opposite sides of the body portion 40. Two pairs of holes 402 are respectively formed at front portion and rear portion of the body portion 40. A downwardly-extending first tab 404 is formed at a front edge of the body portion 40. A pair of second tabs 405 are formed with the body portion 40 extending downwardly from a rear edge of the body portion 40.

In assembly, conductors 70 of the pair of cables 7 are respectively soldered to the second conductive pads 22 of the circuit card 2. The circuit card 2 with the cables 7 is located on the first standoffs 115 of the base 11 with the holes 23 aligned with the first positioning holes and the cables 7 are exited from first semicircular openings (not labeled) of the base 11. The cover 12 is assembled to the base 11 and the circuit card 2 with the posts 1242 protruding through the holes 23 and the first positioning holes to position the circuit card 2 in the receiving space 15 of the housing 1. The circuit card 2 is sandwiched between the base 1 and the cover 12. The pair of tip ends 1140 are received in the gaps 1260, thus, the base 11 and the cover 12 are also securely assembled together. Two pairs of first and second screw holes 1132, 1232 of the base 11 and the cover 12 are respectively aligned with each other to combine into a pair of screw receiving spaces (not labeled).

Referring to FIGS. 1-4 in conjunction with FIGS. 5, 8-9 and 12, the latch mechanism 3 is assembled to the base section 13 of the cover 12 along a vertical direction perpendicular to the front-to-back direction. The pulling member 32 is firstly pressed to the cover 12. The cooperating portion 321 of the pulling member 32 is received in the second recess section 128 of the cover 12, and the intermediate portion 323 with the interference portion 322 are received in the first recess section 127. The stop sections 3222 and the elastic sections 3220 are respectively sliderably received in the different-size first and second recesses with the block section 3224 and claw section 3226 respectively abutting against opposite edges of the large-size second recesses. The latch member 31 is assembled to the cover 12 along the vertical direction and the engaging portion 310 is interferentially received in the slit 1280 by the barbs 3104 of the side sections 3102. The inclined actuation section 312 is located on the slanted surface 3218 of the body section 3212 of the cooperating portion 321. The bar section 3101 of the latch member 31 are located on the ribs 3214 with the enlarged protrusions 3216 located in front of the bar section 3101. A pair of projections of the cover 12 are respectively received in the rectangular holes 3110 and the latches 3112 exposed above the tongue section 14.

The conductive shell 4 is finally assembled to the base section 13 of the cover 12 with the lateral walls 42 and the second tabs 405 respectively received in the recesses formed in the base 13. The first tab 404 of the shell 4 is received in the second recess section 128 of the cover 12. The first tab 404 also presses on the latch member 31 to provide extra return force to the latch member 31 when disengaging the plug connector 100 from the board connector 300. Two pairs of screws are screwed through the shell 4, the cover 12 and the base 11 to retain the shell 4 with the base 11 and the cover 12.

Referring to FIGS. 3-4 in conjunction with FIGS. 6 and 10-12, the board connector 300 is an SFP-type connector and comprises an outer shield housing 8, an inner insulative housing 9 supporting a plurality of terminals 91 therein.

The shield housing 8 is preferably formed from a sheet metal blank through a suitable process, such as a stamping and forming process. The shield housing 8 comprises a main body 80 and a cover portion 81 engaged with the main body 80 to form the whole shield housing 8. The main body 80 of the shield housing 8 comprises a frame 800 formed by four walls and exposed outside of the planar circuit board 400, a pair of sidewalls 802 and a transverse wall 804 which together defining a hollow interior cavity 806. The walls 802, 804 are assembled to the planar circuit board 400 via four bolts 808 screwed from bottom of the circuit board 400 into the two sidewalls 802. The frame 800 defines a leading opening 803 leading the plug connector 100 into the hollow interior cavity 806 and is assembled with a gasket 5 for EMI. The frame 800 also defines a pair of rectangular holes 809 on upper wall thereof. Each sidewall 802 forms a pair of latches 805 spaced arranged on outer periphery thereof. A pair of protrusions 807 are formed on inner periphery of each sidewall 802 for supporting the insertion of the plug connector 100. The protrusions 807 are sized different from each other on the respective sidewalls 802.

The insulative housing 9 is received in front area of the hollow interior space 806 of the main body 80 and defines a card receiving slot 92 circumscribed by four walls thereof. The terminals 91 are arranged into two distinct sets of first terminals 910 and second terminals 912 respectively received in the insulative housing 9 with contacting portions 914 thereof exposed in the card receiving slot 92 for electrically connecting with the circuit card 2 of the plug connector 100 and tail portions 916 thereof surface mounted on the circuit board 400.

The cover portion 81 is a flat metal sheet and forms four tabs 810 downwardly from opposite edges thereof. Each tab 810 forms a hole (not labeled) to latch with corresponding latch 805, respectively for assembled to the main body 80.

Figure 12:
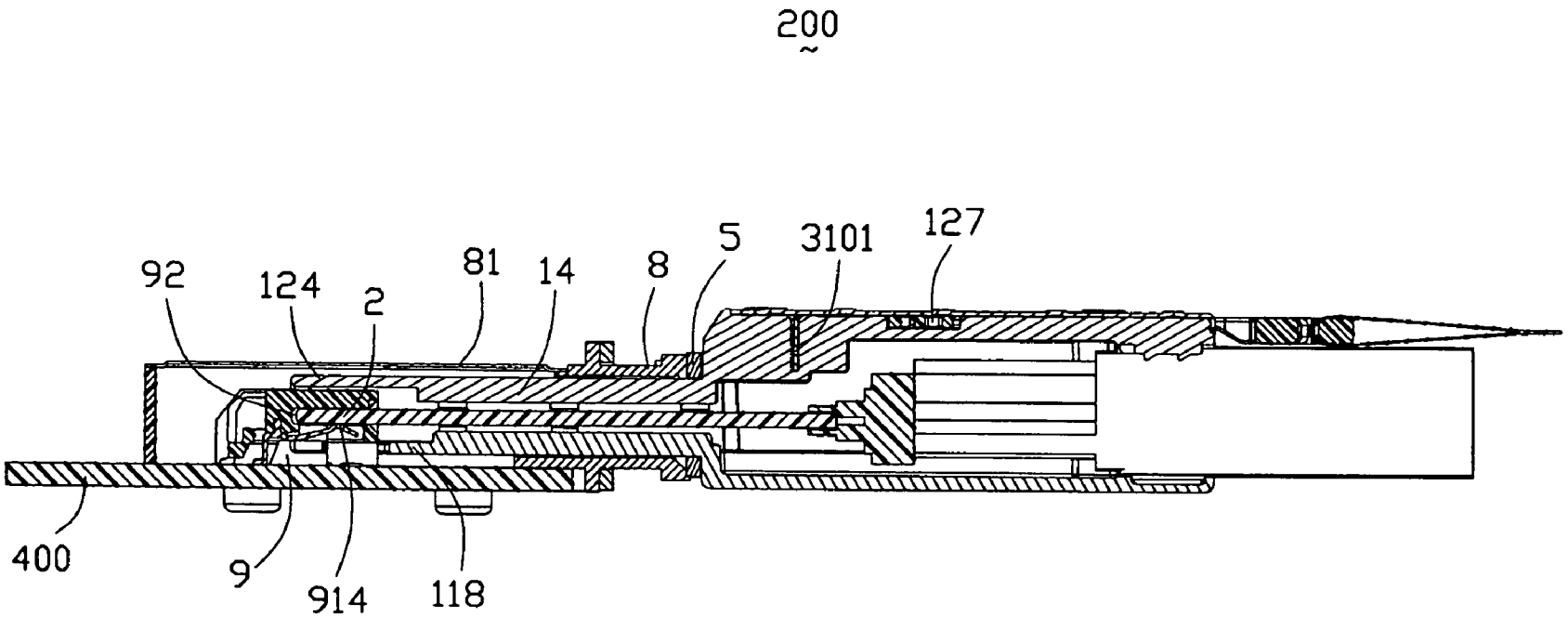
FIG. 12 is a cross-section view taken along line 12-12 of FIG. 10.

Particularly referring to FIG. 12, when the plug connector 100 mates with the board connector 300, the tongue sections 14 of the base 11 and the cover 12 are inserted into the interior space 806 by leading of the leading opening 803 until the pair of latches 3112 of the latch member 31 latch with the pair of holes 809 of the frame 80. The second panel 124 of the tongue section 14 is located above the insulative housing 9, the front end of the circuit card 2 is inserted into the card receiving slot 92 and sandwiched by the contacting portions of the two sets of first and second terminals 910, 912 of the board connector 300 to form electrical connection therebetween, while the first panel 118 shorter than the second panel 124 is stayed out of the insulative housing 9. When inserting, each pair of protrusions 807 enter into corresponding guiding channel 1250 of the tongue section 14 of the cover 12 in turn, thus, supporting the tongue section 14. When the plug connector 100 disengages from the board connector 300, a rearward pulling force exerts to the operating portion 324 of the pulling member 31 or the pull section 332 of the pull tape 33, according to the space left for the operator to operate, to actuate the pulling member 32 rearward move with the elastic sections 3220 and the stop sections 3222 sliding in the second and first recesses until the enlarged protrusions 3216 abut against the bar section 3101 of the latch member 31. The body section 3212 also rearward moves with the slanted surface 3218 sliding along a bottom periphery of the inclined actuation section 312, thus actuating the actuation section 312 to pivot upwardly relative to the bar section 3101 of the engaging portion 310 and the latch section 311 with the latches 3112 to upwardly move to unlatch from the board connector 300. After the rearward pulling force is removed, restore force of the elastic sections 3220 actuates the pulling member 32 to move forwardly to its original position, and thus, the latch member 31 also reverts to its original position. That is to say, when the space left for the operator is large enough, the operator may pull the pulling member 32 or the pull tape 33 to drive the latch member 31 to unlatch from the board connector 300; when the space left for the operator is small, the operator may pull the pull tape 33 to separate the plug connector 100 from the board connector 300.

The plug connector 100 may also be equipped with an EMI gasket 5 assembled to the metal housing 1 for reducing the Electro Magnetic Interference (EMI) in the signal transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a plug connector comprising:

a housing;

a plurality of conductive contacts located in the housing;

at least one cable electrically connecting with the conductive contacts;

a pulling member moveable relative to the housing in a horizontal direction; and a latch member discrete from the pulling member and assembled to the housing, the latch member comprising an engaging portion assembled to the metal housing, a rear actuation section extending from the engaging portion and actuated by a cooperating portion of the pulling member, and a front latch portion extending forwardly from at least one of the engaging portion and the actuation section; and a board connector adapted for mounting on a planar circuit board, comprising:

an outer shield housing defining at least one hole in a rear portion thereof to receive the latch portion of the latch member of the plug connector and an interior cavity in a front portion thereof to receive part of the metal housing of the plug connector;

an insulative housing located in the front portion of the outer shield housing and received in the interior cavity; and a plurality of terminals supported by the insulative housing to electrically connect with the conductive contacts of the plug connector; and wherein the pulling member is capable of actuating the latch portion of the latch member to separate from the hole of the board connector for disengaging the board connector from the plug connector.

2. The electrical connector assembly as claimed in claim 1, wherein the latch member is operated in a lever manner.

3. The electrical connector assembly as claimed in claim 1, wherein the cooperating portion of the pulling member forms a slanted surface located below the actuation section of the latch member and capable of sliding along the actuation section to actuate the latching portion pivotally move relative to the engaging portion to separate from the board connector.

4. The electrical connector assembly as claimed in claim 1, wherein the plug connector further comprises a conductive shell comprising a downwardly-extending tab formed at a front thereof to locate above the latching portion of the latch member for providing extra restore force to the latch member.

5. The electrical connector assembly as claimed in claim 1, wherein the terminals of the board connector are arranged into two distinct sets of first terminals and second terminals, and wherein the conductive contacts are conductive pads of a circuit card received in the housing of the plug connector, and the circuit card is sandwiched by the first and second terminals of the board connector.

6. The electrical connector assembly as claimed in claim 5, wherein the insulative housing defines a card receiving slot with contacting portions of the first and second terminals exposed into the card receiving slot, and wherein the circuit card is inserted into the card receiving slot to form electrical connection with the terminals.

7. The electrical connector assembly as claimed in claim 1, wherein the engaging portion of the latch member locates in a vertical surface and the latching member locates in a horizontal surface, and wherein the housing comprises a base section and a tongue section extending from the base section, the base section defines a slit vertically extending a certain distance from a top surface thereof to receive the engaging portion of the latch member.

8. The electrical connector assembly as claimed in claim 7, wherein the engaging portion is of n-shape and comprises a bar section from which the actuation section extends and a pair of side portions formed with barbs to interferentially engage with the slit.

9. The electrical connector assembly as claimed in claim 1, wherein the shield housing forms a frame defining a leading opening in said rear portion thereof, and wherein the at least one hole is defined in the frame, and the plug connector is inserted from the leading opening into the interior cavity.

10. The electrical connector assembly as claimed in claim 9, wherein the shield housing comprises a pair of sidewalls extending from the frame and a transverse wall connecting with the pair of sidewalls, and wherein the interior cavity is circumscribed by the sidewalls and the transverse wall.

11. The electrical connector assembly as claimed in claim 10, wherein the shield housing further comprises a cover portion assembled to the pair of sidewalls to close the interior cavity.

12. The electrical connector assembly as claimed in claim 11, wherein each sidewall forms at least one latch on outer periphery thereof, and wherein the cover portion defines at least one hole to receive the latch for assembling the cover portion to the sidewalls.

13. The electrical connector assembly as claimed in claim 10, wherein the board connector forms at least one protrusion on inner periphery thereof away from the frame thereof, and wherein the housing of the plug connector defines a guiding channel on outer periphery thereof to receive the at least one protrusion for being supported by the at least one protrusion.

14. The electrical connector assembly as claimed in claim 1, wherein the housing of the plug connector is made of metal material and comprises a base section and a tongue section extending forwardly from the base section, and wherein the tongue section is received in the interior cavity of the board connector.

15. The electrical connector assembly as claimed in claim 14, wherein the latch member is vertically planted into a top surface of the base section and the latching portion thereof partially extends beyond a front surface of the base section to locate above the tongue section.

16. The electrical connector assembly as claimed in claim 14, wherein the pulling member comprises an operating portion extending from the cooperating portion is exposed beyond the base section of the housing.

17. The electrical connector assembly as claimed in claim 16, wherein the pulling member further comprises an intermediate portion connecting the cooperating portion with the operating portion, and wherein the intermediate portion is formed with at least one elastic section for providing restore force to the pulling member and the latch member.

18. The electrical connector assembly as claimed in claim 16, wherein the plug connector further comprises a pull tape assembled to the operating portion and wholly exposed beyond the base section of the housing.

19. An electrical connector assembly comprising:

a printed circuit board;

a receptacle connector including a first receptacle housing seated upon the printed circuit board with a plurality of first contacts therein, and a second receptacle housing and cooperating with the printed circuit board to enclose the first receptacle housing wherein the second receptacle housing is essentially spaced from the first receptacle housing without direct assembling thereto;

a plug connector including a mating section with a plurality of second contacts thereon, and a plug housing protectively enclosing said mating section;

the mating section being compliantly coupled to the first receptacle housing under a condition that the first contacts and the second contacts are mechanically and electrically engaged with each other;

the plug housing compliantly coupled to the second receptacle housing under a condition that keying structures are formed on both lateral sides of both the plug housing and the second receptacle housing in an asymmetrical manner to perform both guiding and orientation functions during mating of the plug housing and the second receptacle housing.

20. The assembly as claimed in claim 19, wherein the keying structures on one of said plug housing and said second receptacle housing are arranged with intervals.

* * * * *